US007802969B2

(12) United States Patent
Lee et al.

(10) Patent No.: US 7,802,969 B2
(45) Date of Patent: Sep. 28, 2010

(54) FAN AND IMPELLER THEREOF

(75) Inventors: Chin-Hong Lee, Taoyuan Hsien (TW); Sung-Wei Lee, Taoyuan Hsien (TW); Wen-Shi Huang, Taoyuan Hsien (TW)

(73) Assignee: Delta Electronics, Inc. (TW)

( * ) Notice: Subject to any disclaimer, the term of this patent is extended or adjusted under 35 U.S.C. 154(b) by 740 days.

(21) Appl. No.: 11/790,422

(22) Filed: Apr. 25, 2007

(65) Prior Publication Data

US 2007/0258812 A1 Nov. 8, 2007

(30) Foreign Application Priority Data

May 2, 2006 (TW) ..... 95115550 A

(51) Int. Cl.
*F04D 29/38* (2006.01)

(52) U.S. Cl. ..... 416/241 R; 416/234; 415/211.2; 415/220

(58) Field of Classification Search ..... 416/241 R, 416/243, 234, 238; 415/211.2, 220
See application file for complete search history.

(56) References Cited

U.S. PATENT DOCUMENTS

| | | | | |
|---|---|---|---|---|
| 4,569,631 | A * | 2/1986 | Gray, III | 416/189 |
| 5,769,607 | A * | 6/1998 | Neely et al. | 416/189 |
| 5,961,289 | A * | 10/1999 | Lohmann | 416/189 |
| 6,902,377 | B2 * | 6/2005 | Crocker | 416/223 R |
| 7,275,911 | B2 * | 10/2007 | Lee et al. | 415/211.2 |
| 2006/0110252 | A1 * | 5/2006 | Horng et al. | 416/179 |

* cited by examiner

*Primary Examiner*—Ninh H Nguyen
(74) *Attorney, Agent, or Firm*—Birch, Stewart, Kolasch & Birch, LLP

(57) ABSTRACT

A fan includes a housing, an impeller and a motor. The housing has a main body, a motor base and at least one supporting member disposed between the main body and the motor base. The impeller is disposed on the motor base and has a hub and a plurality of blades disposed around the hub. The motor is connected to the impeller for driving the impeller to rotate. Each of the blades is connected to the hub at a predetermined angle ranging from 22.5 degrees to 36 degrees.

18 Claims, 4 Drawing Sheets

FAN AND IMPELLER THEREOF

The present application claims priority under U.S.C. §119 (a) on Patent Application No(s). 095115550 filed in Taiwan, Republic of China on May 02, 2006, the entire contents of which are hereby incorporated by reference.

BACKGROUND OF THE INVENTION

1. Field of the Invention

The invention relates to a fan and an impeller thereof, and more particularly to a quiet and highly efficient fan and an impeller thereof.

2. Description of the Related Art

As electronic devices are continuously improved, heat-dissipating devices and systems become increasingly important. Accumulation of heat reduces efficiency and may damage an electronic device. As integrated circuits continue to shrink and packaging is continuously developed to increase integration density, heat on each unit area of the integrated circuits increases. Thus, a heat-dissipating device with a high heat-dissipating efficiency must be developed.

Fans, a kind of a heat-dissipating device, are typically applied to electronic devices. Referring to FIGS. 1A and 1B, FIG. 1A is a schematic view showing a conventional impeller of a fan and FIG. 1B is a schematic view showing a blade of a conventional impeller installed at a setting angle. In FIG. 1A, the conventional impeller 12 includes a hub 121 and a plurality of blades 122 disposed around the hub 121. The blades 122 are typically installed around the hub 121 at an angle greater than 40 degrees in order to generate high pressure and large wind volume. FIG. 1B discloses that the setting angle θ1 at which the blade 122 is installed, is greater than 40 degrees.

When airflow passes through the blades 122, an inflow angle (θ1-θr1) is generated. Because the setting angle θ1 and the inflow angle (θ1-θr1) are overlarge, flow separation occurs at a suction surface of the blade, and then a turbulence is generated.

Pressure vibration caused by turbulence brings noise of boardband. Also, the overlarge setting angle θ1 increases the pressure variation at the surface of the blade 122, and then noise bandwidth and prominence ratio increases. In addition, because a conventional fan is driven by high electric current and speed stalls may occur early, a static pressure of an operating region of the fan decreases, and efficiency of the conventional fan is reduced. Thus, the conventional fan has disadvantages of consuming excessive power, generating excessive noise and having a low static pressure in an operating region.

BRIEF SUMMARY OF INVENTION

The invention provides a fan and an impeller thereof with a special design of reducing the setting angle of blades so as to decrease load and power consumption of the fan, whereby increasing fan efficiency and improving defects of the conventional fan. Also, the impeller of the invention has a proportional hub and blade ratio so as to improve flow field, reduce noise, and increase static pressure of the operating region. As the results, the fan efficiency is improved.

A fan is provided according to the preferred embodiment of the present invention. An axial fan is provided as an example. The fan includes a housing, an impeller and a motor. The housing includes a main body, a motor base and at least one supporting member. The motor base is disposed between the main body and the supporting member. The impeller is disposed on the motor base and has a hub and a plurality of blades disposed around the hub. The motor is connected to the impeller for driving the impeller to rotate. Each of the blades is connected to the hub at a predetermined angle ranging from 22.5 to 36 degrees.

A shape of the main body is rectangular, circular, elliptical or rhombic. The main body includes a length and a height, and the length divided by the height has a value ranging from 0.3 to 0.7. The length of the main body is greater than or equals to 38.0 mm. The supporting member is suas as a rib or a stator blade, and one end of the supporting member extends upward. Further, the main body has an air inlet, an air outlet and at least one expanding portion connected to the main body and installed at the air inlet or the air outlet so as to increase the airflow. The expanding portion preferably has a lead angle, an oblique angle, a chamfer angle or an R angle.

Also, an impeller is provided according to the preferred embodiment of the present invention. The impeller includes a hub and a plurality of blades disposed around the hub. Each of the blades is connected to the hub at a predetermined angle ranging from 22.5 degrees to 36 degrees. Each of the blades has an outer edge (b1) and an inner edge (b2), the outer edge is spaced apart from the hub, and the inner edge is connected to the hub. A blade ratio (A) is defined as a blade length (W) divided by the average of the outer edge and the inner edge and the blade ratio (A) ranges from 0.2 to 2.0.

One end of each blade of the impeller of the invention extends upward. Also, each of the blades includes a guiding line which is revealed in a cross-section of the blade and extends from the inner edge to the outer edge. The guiding line is a straight line or a curved line. The hub and the blades are integrally formed as a single piece. The hub and the blades are made by plastics, acrylic, metal or alloy.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
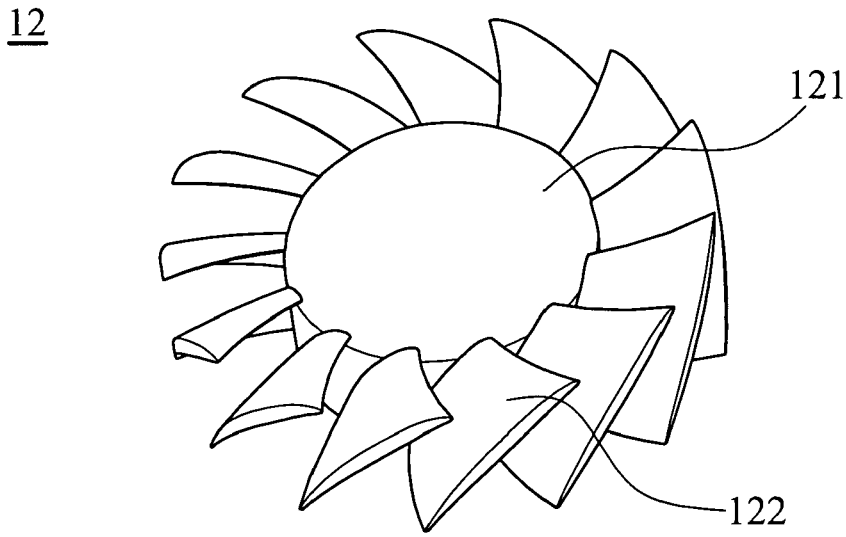
FIG. 1A ( PRIOR ART )
FIG. 1A is a schematic view of an impeller of a conventional fan.
Figure 1B:
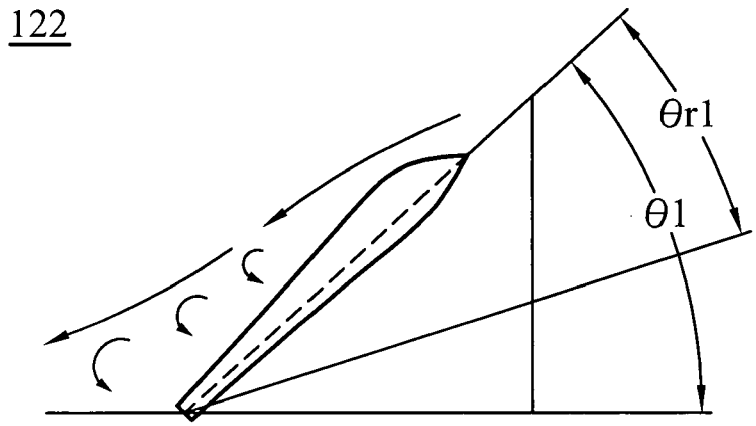
FIG. 1B ( PRIOR ART )
FIG. 1B is a schematic view showing a blade of a conventional impeller in FIG. 1A installed at a setting angle.
Figure 2:
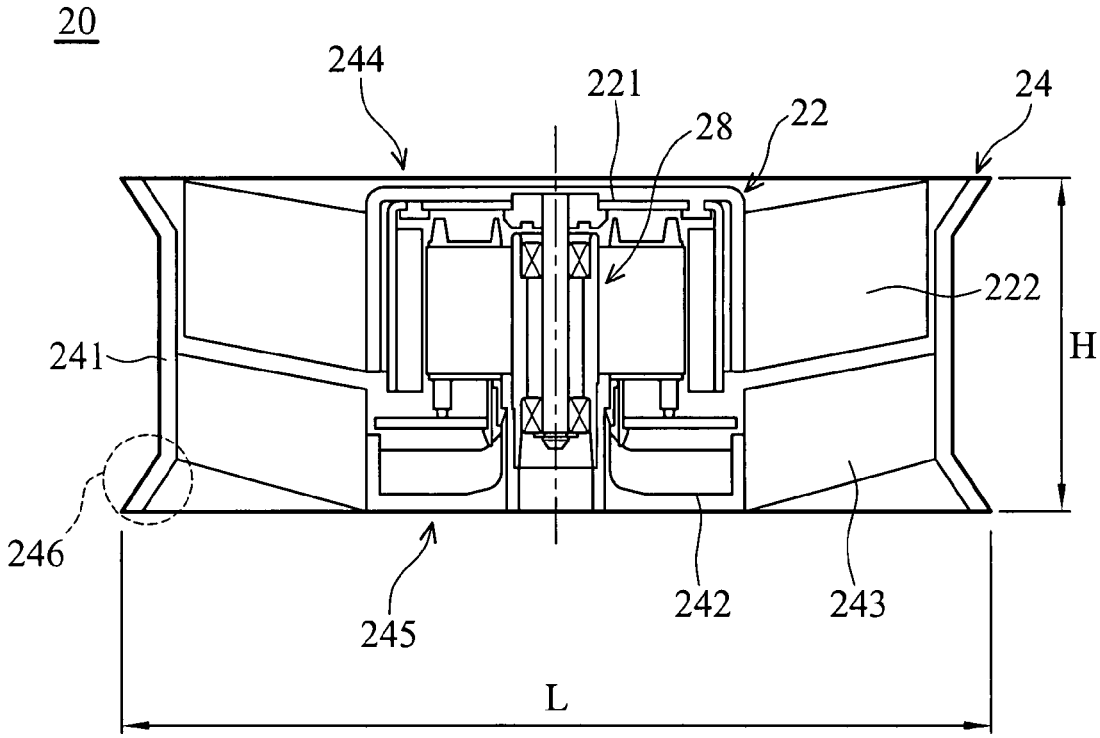
FIG. 2 is a cross-sectional view of an embodiment of a fan of the present invention.

FIG. 2 is a cross-sectional view of an embodiment of a fan of the present invention. A fan 20, such as an axial fan, includes a housing 24, an impeller 22 and a motor 28. The housing 24 has a main body 241, a motor base 242 and at least one supporting member 243. The motor base 242 is disposed between the supporting member 243 and the main body 241. The impeller 22 is disposed on the motor base 242 and includes a hub 221 and a plurality of blades 222 disposed around the hub 221. The motor 28 is connected to the impeller 22 for driving the impeller 22 to rotate.

Figure 3:
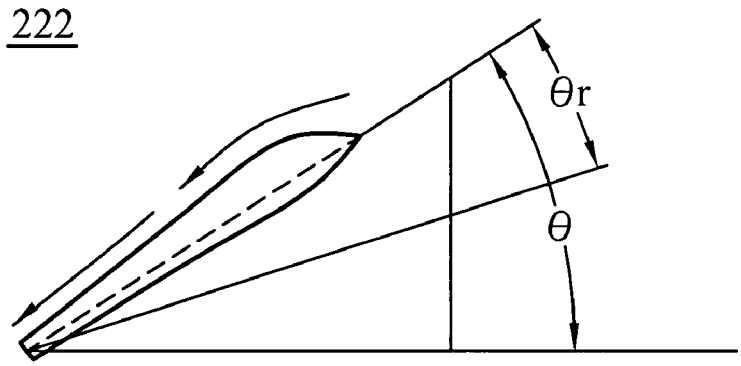
FIG. 3 is a schematic view showing a blade of an impeller in FIG. 2 installed at a predetermined angle.

Considering that the conventional fan has an overlarge setting angle, which causes an overlarge inflow angle, resulting in flow separation, and even, high load and power consumption of the fan. To prevent this disadvantage of a conventional fan, each of the blades 222 of the present invention is connected to the hub 221 at a predetermined angle which ranges from 22.5 degrees to 36 degrees. FIG. 3 is a schematic view showing the blade of the impeller in FIG. 2 installed at the predetermined angle. The predetermined angle of the blade 22 is defined by an included angle forming a datum line from a tip of the blade to the connection of the blade 222 and hub 221, and a datum surface perpendicular to the axial direction.

In this embodiment, because the predetermined angle of the blade 222 is less than 36 degrees, thus, airflow flows along the blade surface smoothly and prevents turbulence. Moreover, increasing the rotation speed of the fan provides a high but stable wind pressure and wind volume. Increasing the rotation rate results in high power consumption, the fan of the invention, however, is a heat-dissipating device with low power consumption. Thus, power consumption of the fan of the present invention is still less than a conventional fan. Note that an over-small setting angle does not generate airflow. The proper setting angle ranges from 22.5 degrees to 36 degrees.

Figure 4:
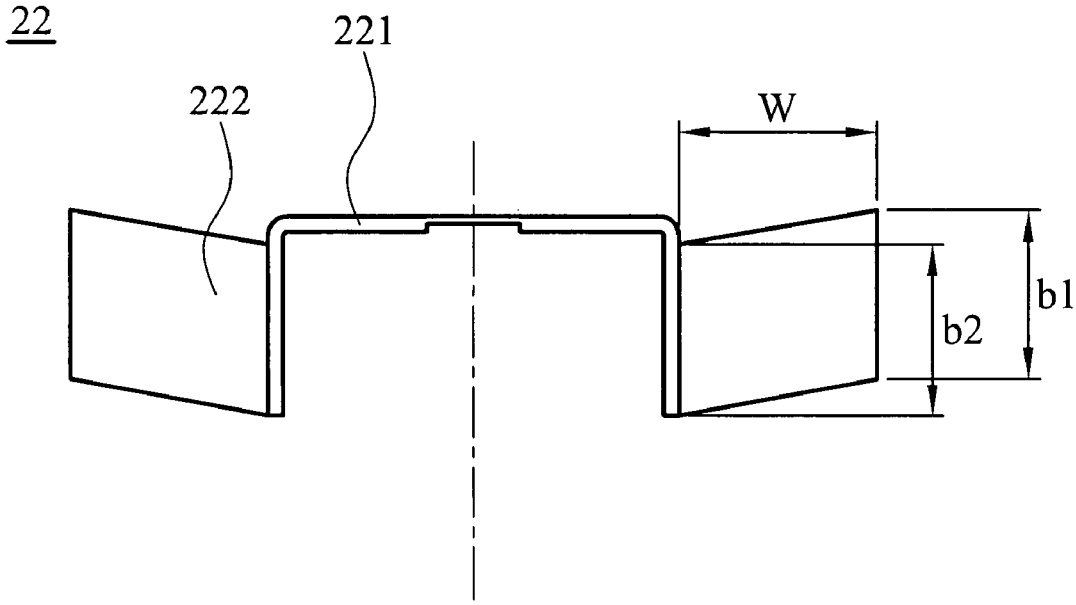
FIG. 4 is a schematic view of a blade ratio of a blade in FIG. 2.

Referring to FIGS. 2 to 4, FIG. 4 is a schematic view showing the blade ratio in FIG. 2. One end of each blade 222 of the impeller 22 extends upward. Each blade 222 has a guiding line which is revealed in a cross-section of the blade 222 and extends from the inner edge (b2) to the outer edge (b1). The guiding line may be a straight line or a curved line. The hub 221 and the blades 222 are integrally formed as a single piece. The hub 221 and the blades 222 include plastics, acrylic, metal or alloy.

Considering that a fan has the best efficiency and ability to overcome system impedance, provide stable wind volume and the lowest noise bandwidth before a speed stall occurs. In a fan, static pressure increases efficiency more than dynamic pressure. If the static pressure of an operating region is increased, fan efficiency increases. Fan efficiency ($\eta$) is defined as the formula as below:

$$\eta = \frac{(Ps + Pv) * Q}{I * V}$$

$Ps$: Static pressure $Pv$: Dynamic pressure $Q$: Wind volume $I$: Input current $V$: Input voltage Because the predetermined angle is less than 36 degrees, load of the fan 20 decreases. Thus, providing a high rotational velocity of the fan 20 of the invention which is greater than in a conventional fan under the situation of the same power provided. Moreover, because the static pressure is in direct proportion to the square of the rotational velocity ($P \alpha V^2$), the static pressure of the operating region thus increases. Decreasing the setting angle improves fan efficiency, however, the blade ratio must be considered to maintain wind pressure and volume simultaneously. Short blade height or short blade length does not provide enough work area, resulting in decreased wind volume and static pressure area in the operating region. Conversely, high blade height or long blade length increases load of the fan, decreasing efficiency, resulting in extension of the speed stall. Thus, the electric current is suddenly raised under high back-pressure conditions. The blade ratio is limited for improving fan efficiency.

In this embodiment, the main body has a length which is greater than or equals to 38.0 mm. The main body length divides the main body height has a value (N) ranging from 0.3 to 0.7. The value (N) is defined as the formula as below:

$$N = \frac{H}{L}$$

$H$: Height of the main body $L$: Length of the main body

Each of the blades includes an outer edge (b1) and an inner edge (b2). The outer edge (b1) is spaced apart from the hub 221, and the inner edge (b2) is located at the connection of the hub 221 and the blades 222. A blade ratio (A) ranges from 0.2 to 2.0. The blade ratio (A) is defined as the formula as below:

$$A = \frac{W}{\left(\frac{b1 + b2}{2}\right)}$$

$W$: Blade length $b1$: Outer edge of each blade $b2$: Inner edge of each blade

The blade ratio (A) is defined as a blade length (W) divided by the average of the outer edge and the inner edge, ranges from 0.2 to 2.0. The supporting member 243 is connected to the main body 241 and the motor base 242 and the supporting member 243 is preferably a rib or a stator blade. One end of the supporting member 243 extends upward for preventing airflow extension. Also, the location of the supporting member 243 disposed between the main body 241 and the motor base 242 can be adjusted to a proper position in accordance with the blades 222 (rotor blades).

The shape of the main body 241 of the fan 20 is not limited. The shape of the main body 241 may be rectangular, circular, elliptical or rhombic. Further, the main body 241 includes an air inlet 244, an air outlet 245 and at least one expanding portion 246, as shown in FIG. 2 which shows that the expanding portion 246 is connected to the main body 241 and is installed at the air inlet 244 or the air outlet 245 so as to increase airflow. The expanding portion 246 may be a lead angle, an oblique angle, a chamfer angle or an R angle.

Figure 5:
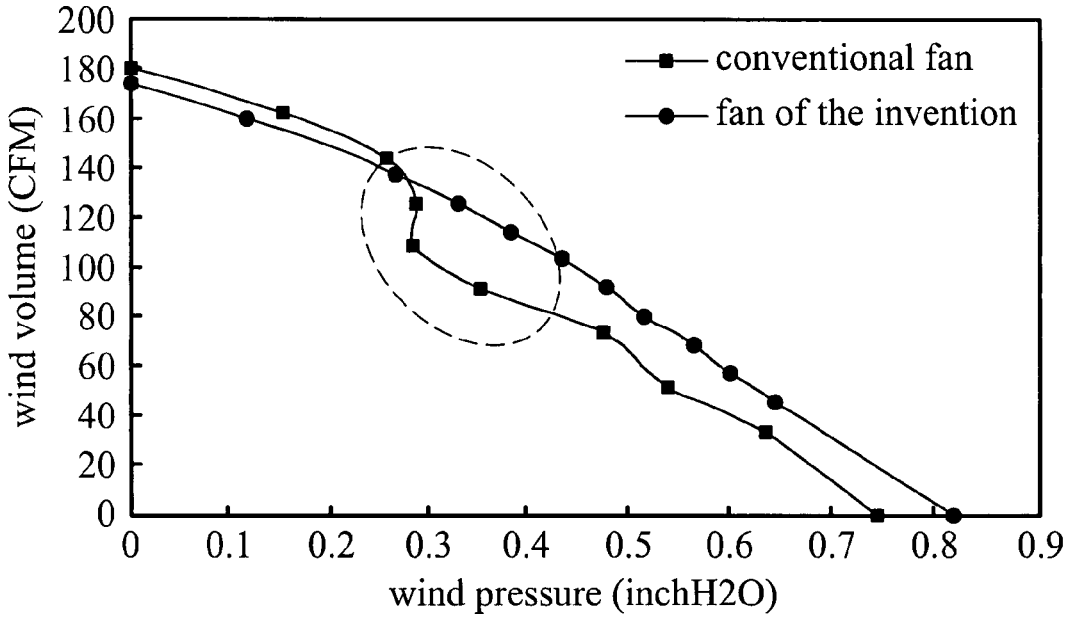
FIG. 5 is a diagram of curves of an experiment with a conventional fan and a fan of the present invention showing the relationship of wind pressure and wind volume.

FIG. 5 is a diagram of curves of an experiment with a conventional fan and a fan of the present invention showing the relationship between wind pressure and wind volume. The X axial in FIG. 5 shows wind pressure (inchH2O), and the Y axial in FIG. 5 shows wind volume (CFM). Compared with the conventional fan, the speed stall of the fan of the present invention is less than the conventional fan. At high pressure, the wind volume of the fan of the present invention is more than the conventional fan thereof. According to the diagram of the curves of the experiment, the present invention provides a fan with high efficiency for reducing load of the fan and power consumption.

Figure 6:
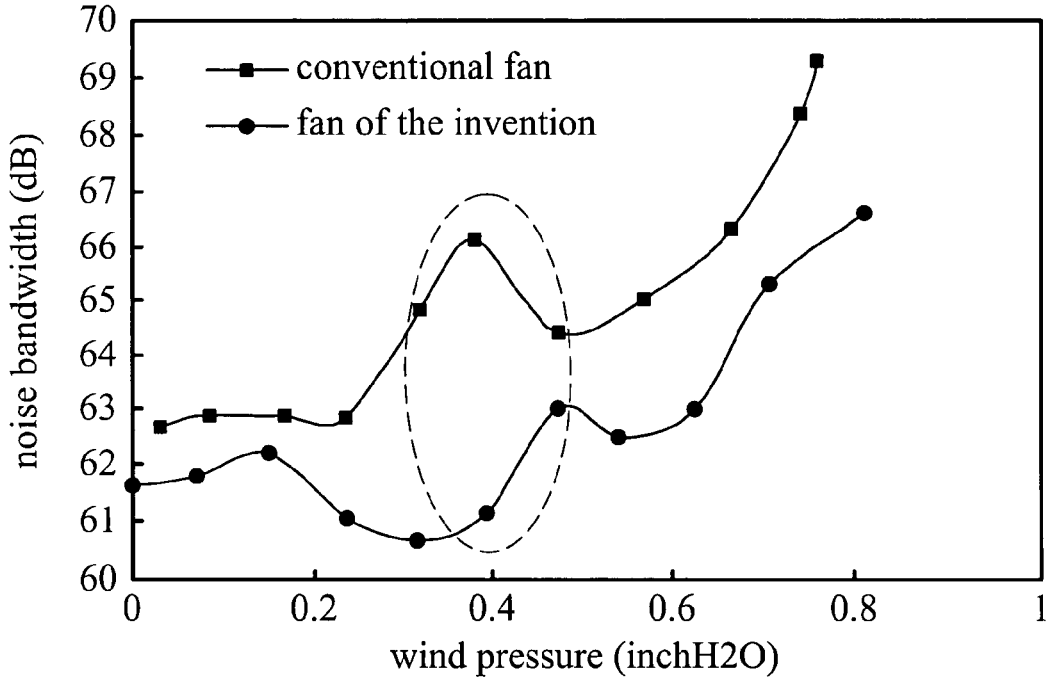
FIG. 6 is a diagram of curves of an experiment with a conventional fan and a fan of the present invention showing the relationship of wind pressure and noise bandwidth.

Because turbulence typically generated at the air inlet or where the airflow separates results in noise, and turbulence caused by speed stalls in particular is excessively noisy. The 12 cm fan of the present invention was compared with a conventional 12 cm fan in a noise test. FIG. 6 is a diagram of the curves of an experiment with a conventional fan and a fan of the present invention showing the relationship of wind pressure and noise bandwidth. The X axial in FIG. 6 shows wind pressure (inchH2O), and the Y axial in FIG. 6 shows noise bandwidth (db). Because the fan of the present invention decreases speed stalling, the fan of the present invention has less noise bandwidth than a conventional fan. As the results, the curve of the fan of the present invention is better than a conventional fan. Therefore, the design of decreasing setting angles of the blades reduces and delays the airflow separation for reducing noise generated by turbulence. Thus, the fan and the impeller of the present invention reduce noise and increase wind pressure and wind volume.

In summary. The design of reducing setting angles of blades decreases load and power consumption of the fan and increases fan efficiency. An impeller of the present invention has optimal hub to blade ratio for improving the flow field, decreasing noise, increasing static pressure in the operating region, and improving fan efficiency.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An impeller, comprising:

a hub; and a plurality of blades disposed around the hub;

wherein each of the blades is connected to the hub at a predetermined angle ranging from 22.5 degrees to 36 degrees;

wherein each of the blades comprises an outer edge (b1) and an inner edge (b2), the outer edge is spaced apart from the hub, the inner edge is connected to the hub, and a blade ratio (A) is defined that a blade length (W) divides the average of the outer edge and the inner edge, ranges from 0.2 to 2.0.

2. The impeller as claimed in claim 1, wherein each of the blades comprises a guiding line which is revealed in a cross-section of the blade and extends from the inner edge to the outer edge.

3. The impeller as claimed in claim 2, wherein the guiding line is a straight line or a curved line.

4. The impeller as claimed in claim 1, wherein the hub and the blades are integrally formed as a single piece, and the hub and the blades are made of plastics, acrylic, metal or alloy.

5. The impeller as claimed in claim 1, wherein one end of each of the blades extends upward.

6. A fan, comprising:

a housing comprising a main body, a motor base, and at least one supporting member disposed between the main body and the motor base;

an impeller disposed on the motor base and comprising a hub, and a plurality of blades disposed around the hub; and a motor connected to the impeller for driving the impeller to rotate;

wherein each of the blades is connected to the hub at a predetermined angle ranging from 22.5 degrees to 36 degrees;

wherein each of the blades comprises an outer edge (b1) and an inner edge (b2), the outer edge is spaced apart from the hub, the inner edge is connected to the hub, and a blade ratio (A) is defined as a blade length (W) divided by the average of the outer edge and the inner edge, ranges from 0.2 to 2.0.

7. The fan as claimed in claim 6, wherein each of blades comprises a guiding line which is revealed in a cross-section of the blade and extends from the inner edge to the outer edge.

8. The fan as claimed in claim 7, wherein the guiding line is a straight line or a curved line.

9. The fan as claimed in claim 6, wherein the main body comprises a length and a height, and the length divided by the height has a value ranging from 0.3 to 0.7.

10. The fan as claimed in claim 6, wherein the main body has a length which is greater than or equals to 38.0 mm.

11. The fan as claimed in claim 6, wherein the hub and the blades are integrally formed as a single piece.

12. The fan as claimed in claim 6, wherein the hub and the blades are made of plastics, acrylic, metal or alloy.

13. The fan as claimed in claim 6, wherein one end of each of the blades extends upward.

14. The fan as claimed in claim 6, wherein the supporting member is a rib or a stator blade.

15. The fan as claimed in claim 14, wherein one end of the supporting member extends upward.

16. The fan as claimed in claim 6, wherein the main body comprises an air inlet, an air outlet and at least one an expanding portion, and the expanding portion is connected to the main body and installed at the air inlet or the air outlet so as to increase the airflow.

17. The fan as claimed in claim 16, wherein the expanding portion comprises a lead angle, an oblique angle, a chamfer angle or an R angle.

18. The fan as claimed in claim 6, wherein the fan is an axial flow fan, and a shape of the main body is rectangular, circular, elliptical or rhombic.

* * * * *